United States Patent [19]

Pitts

[11] Patent Number: 4,979,915

[45] Date of Patent: Dec. 25, 1990

[54] WIRE TO WIRE ELECTRICAL CONNECTOR WITH BLADE CONTACT

[75] Inventor: Robert W. Pitts, Oak Ridge, N.C.

[73] Assignee: AMP Incorporated, Harrisburg, Pa.

[21] Appl. No.: 410,186

[22] Filed: Sep. 20, 1989

[51] Int. Cl.[5] ..... H01R 13/04; H01R 13/428

[52] U.S. Cl. ..... 439/884; 439/595; 439/851

[58] Field of Search ..... 439/884, 885, 888, 889, 439/891, 595, 851; 29/847, 876, 882–885

[56] References Cited

U.S. PATENT DOCUMENTS

| | | | |
|---|---|---|---|
| 3,420,887 | 1/1969 | Hatfield et al. | 29/874 |
| 3,550,856 | 12/1970 | Wise et al. | 339/276 |
| 3,989,396 | 11/1976 | Manning | 339/258 S |
| 4,149,768 | 4/1979 | Wise | 339/276 S F |
| 4,253,718 | 3/1981 | Bungo | 339/59 R |
| 4,295,698 | 11/1981 | Chow | 339/59 R |
| 4,448,468 | 5/1984 | Coldren | 339/74 R |
| 4,544,220 | 10/1985 | Aiello et al. | 339/59 M |
| 4,753,612 | 6/1988 | Betsui | 439/596 |
| 4,758,183 | 7/1988 | Aoyama | 439/596 |

OTHER PUBLICATIONS

IBM Bulletin, Uberbacher, vol. 15, No. 2, p. 465, 07–1972.

AMP Catalog 86–783, issued 02–1987.

AMP Brochure–Automachine and General Products, © Sep. 1987.

*Primary Examiner*—Neil Abrams

*Attorney, Agent, or Firm*—Allan B. Osborne; Robert W. Pitts

[57] ABSTRACT

An electrical connector assembly includes a blade and a matable receptacle terminal and matable insulative housings in which the blade and receptacle are mounted. Both the blade and the receptacle terminals are centrally positioned so that orientation of the terminals is unnecessary and each terminal has a contact positioning section which conforms to the contour of a housing cavity. This contact positioning section is a box section with a centrally disposed flat blade extending from one rectangular contact positioning section and a spring receptacle extending the other. The blade terminal is formed by folding edge portions of a flat blank to form a dual thickness blade. The edge portions are juxtaposed when folded over flaps which initially comprise integral sections of the flat blank outboard of the edge portions of the blade.

20 Claims, 7 Drawing Sheets

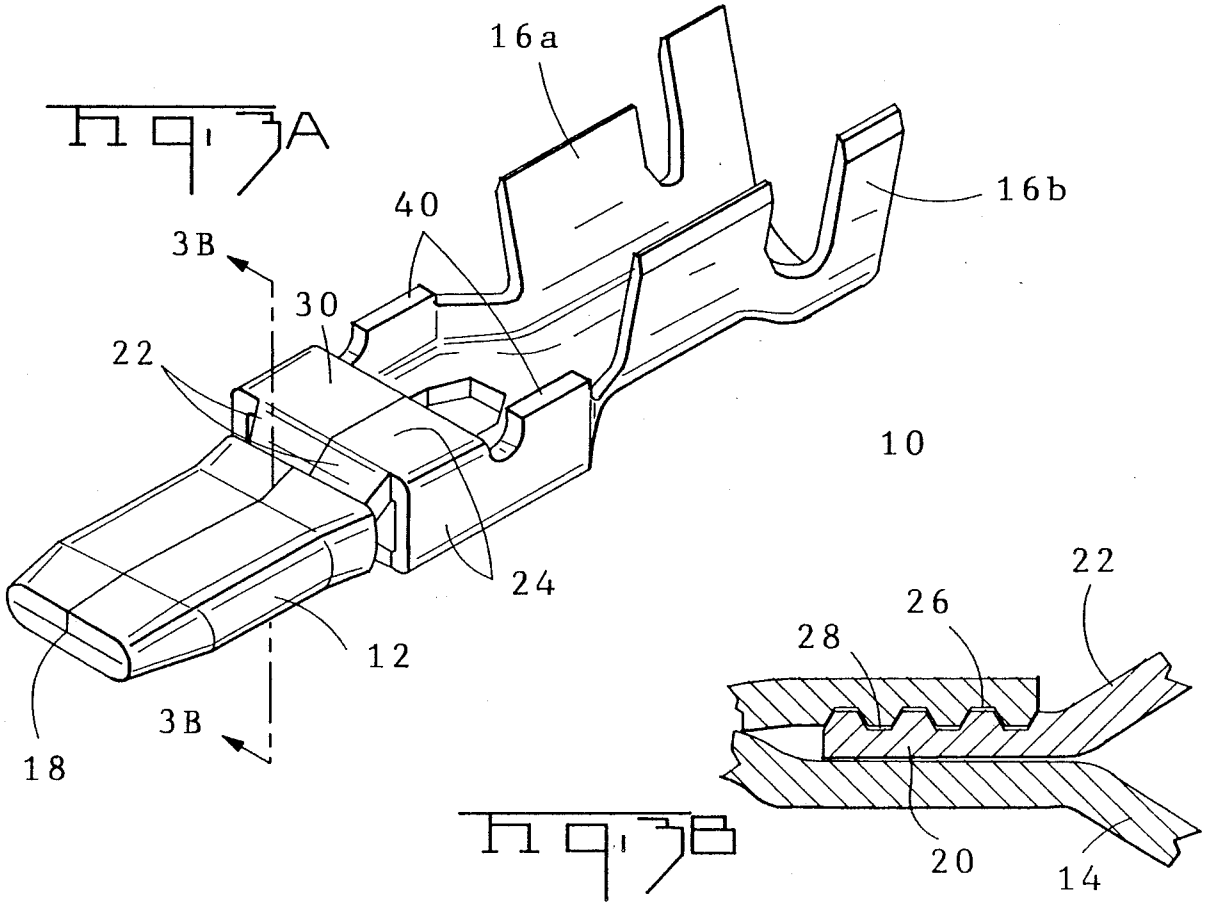
16b
16a
10
40
30
22
3B
3B
A
24
12
18
22
26
28
20
14

WIRE TO WIRE ELECTRICAL CONNECTOR WITH BLADE CONTACT

BACKGROUND OF THE INVENTION

1. Field of the Invention

This invention relates to electrical connectors and more specifically to disconnectable electrical connectors comprising a blade contact matable with a receptacle contact terminals is mounted in an insulative housing containing one or more of the matable terminals.

2. Description of the Prior Art

Pin and socket electrical terminals of the type shown in U.S. Pat. No. 4,544,220 are commonly employed to connect wires in separate electrical harnesses. These pin and socket electrical connectors are commonly employed in industries such as the appliance and automotive industries. Since pin and socket terminals are symmetrical in nature, they can be easily employed in applications where the terminals are first attached to appropriate wires in a harness and then inserted into an insulative housing having a plurality of cavities, because the operator need not orient the symmetrical terminals prior to insertion into the appropriate cavity. One drawback of conventional pin and socket terminals, however is that their symmetrical nature makes it impossible to precisely define a contact interface between the cylindrical pin and the cylindrical socket. Even if a contact point could be initially specified, that contact point would change during the life of the contact due to vibration, thermal cycling and perhaps other factors.

Unlike conventional pin and socket connectors, disconnectable connectors employing blade and receptacle terminals such as FASTON terminals do permit establishment of a stable contact interface. FASTON is a trademark of AMP Incorporated. These disconnectable connectors employ a blade terminal which mates with a receptacle terminal having a relatively stiff spring in the form of curved sections extending laterally from the sides of the base of the receptacle terminal with the edges of the curved spring sections engaging the blade. Examples of disconnectable connectors of this type are shown in U.S. Pat. No. 3,550,856; U.S. Pat. No. 3,989,346; U.S. Pat. No. 4,149,768; and U.S. Pat. No. 4,295,698. These patents show that individual receptacle terminals and individual tabs are commonly mounted in single position insulative sleeves. Note, however, that the terminals shown in this patents are asymmetrically positioned within the sleeves relative to the center lines of the housings and the axis of the wires to which the terminals are attached. U.S. Pat. No. 4,448,468 discloses a receptacle terminal which is positioned generally on the center line of the housing. Note, however, that none of these patents shows a tab and receptacle terminal, each mounted within a housing, in which both the terminals and the housings are matable. Furthermore, these patents show terminals of this type employed in single position instead of multi-position housings. Therefore connectors of this type do not offer some of the same advantages as pin and socket terminals do, especially when used to fabricate a plurality of wire to wire interconnections in a harness.

One conventional use of disconnectable receptacle terminals, of the type just described, in a multiple position housing is for use in a connector which can be mated with a plurality of flat terminals in a printed circuit board header. An example of one such connector is shown in U.S. Pat. No. 4,758,183. Another multiple position connector having this type of receptacle contact is shown in U.S. Pat. No. 4,753,612. U.S. Pat. No. 4,253,718 discloses a multiple position electrical connector in which a plurality of blade terminals attached to wires are positioned in an insulative housing. None of these patents, however, disclose wire to wire multiple position electrical connectors having matable blades and receptacle terminals mounted in matable insulative housings. Furthermore, none of these patents shows matable connector subassemblies in which multiple blade and receptacle contacts are symmetrically positioned within the housing with the mating ends of the terminals located on the center line of the cavities in which the terminals are positioned. In other words, none of these patents discloses a connector in which orientation of the blade and receptacle terminals relative to the housings and to each other is unnecessary.

SUMMARY OF THE INVENTION

An electrical connector assembly including a blade and a matable receptacle terminal also includes matable insulative housings in which the blade and receptacle are mounted. Both the blade and the receptacle terminals are centrally positioned within the housings so that orientation of the terminals is unnecessary. Both the blade and the receptacle terminals have a contact positioning section which conforms to the contour of the housing in which the respective terminal is positioned. In the preferred embodiment, this contact positioning section is rectangular to form a box section with a centrally disposed flat blade extending from the rectangular contact positioning section in one terminal and a spring receptacle extending from the rectangular contact positioning section in the other terminal.

The blade terminal is characterized in that the blade is formed by folding edge portions of a flat blank to form a dual thickness blade. The edge portions are juxtaposed when folded over at least one flap. Each flap initially comprises an integral section of the flat blank outboard of the edge portions of the blade.

BRIEF DESCRIPTION OF THE DRAWINGS

FIGS. 3A and 3B are perspective views of the blade terminal. FIG. 3A shows an uncrimped terminal and FIG. 3B, taken along section lines 3B—3B, shows the manner in which the folded edge portions of the blade engage the flap section.

DETAILED DESCRIPTION OF THE PREFERRED EMBODIMENT

Figure 1:
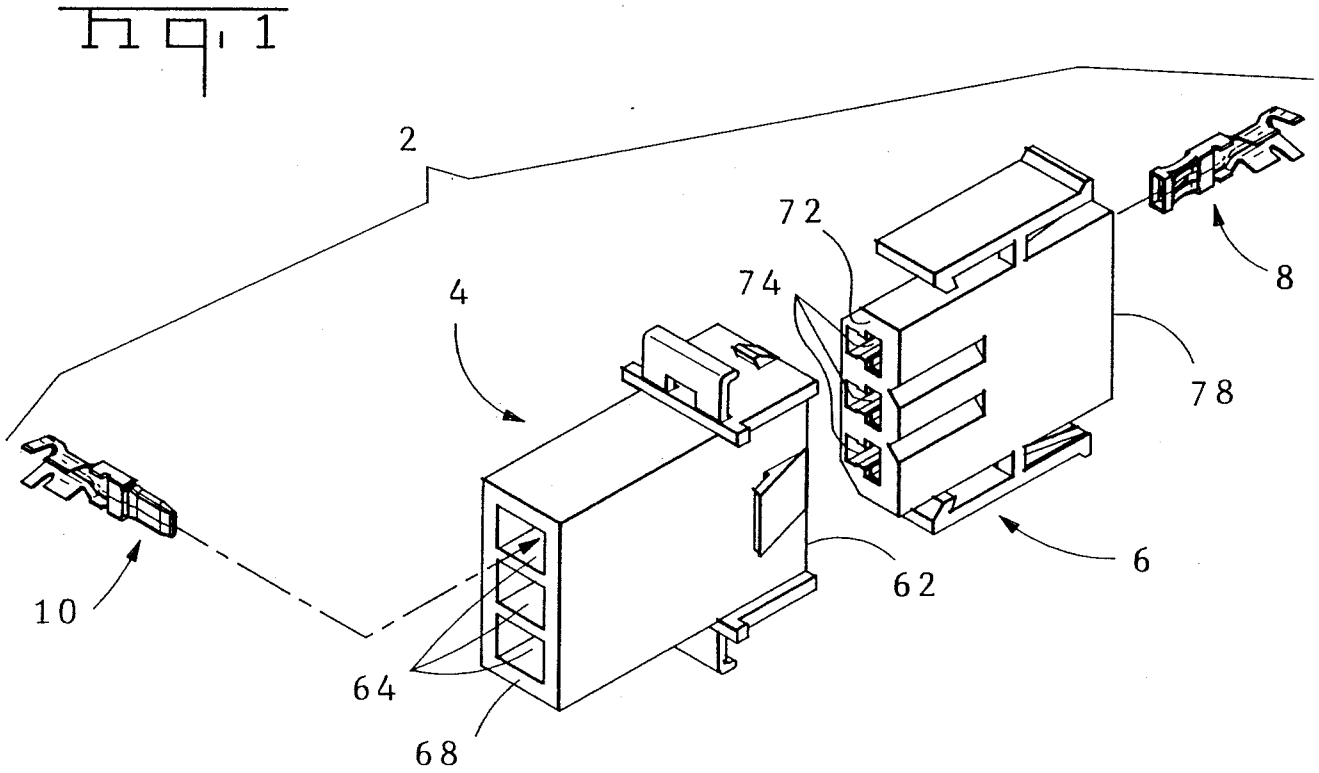
FIG. 1 is an exploded perspective view illustrating the components of the wire to wire blade and receptacle electrical connector assembly.

The preferred embodiment of the electrical connector assembly 2 depicted herein comprises intermatable insulative housings 4 and 6, each containing a plurality of terminals. Receptacle terminals 8 are positioned within contact receiving cavities 70 in insulative housing 6, and blade terminals 10 are positioned within contact receiving cavities 60 in insulative housing 4. Each of the insulative housings is fabricated from a conventional plastic material of the type commonly used for electrical connector housings. Similarly, the terminals are fabricated from conventional spring metal of the type commonly used in electrical terminals.

Figure 2A:
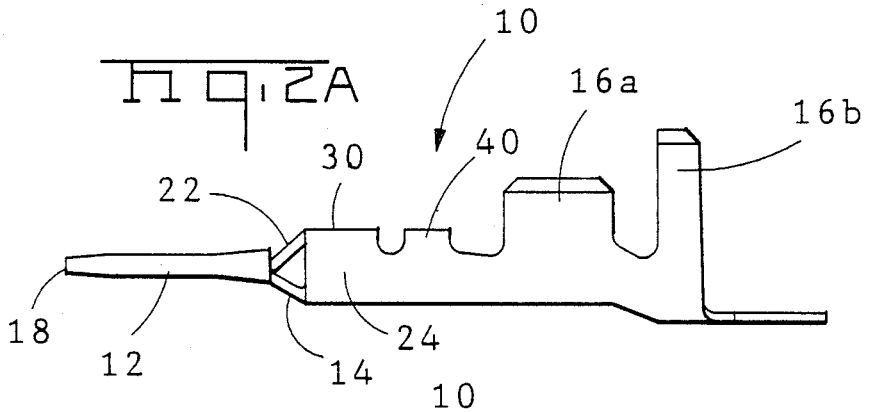
FIGS. 2A, 2B, and 2C are respectively front, side and plan views of a blade terminal.
Figure 2B:
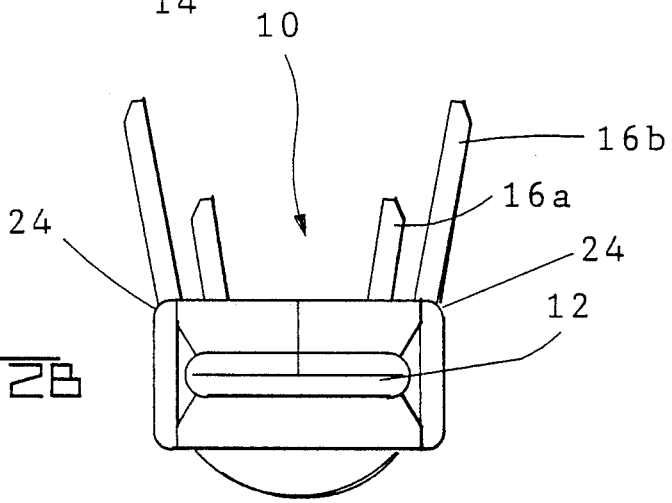
Figure 2C:
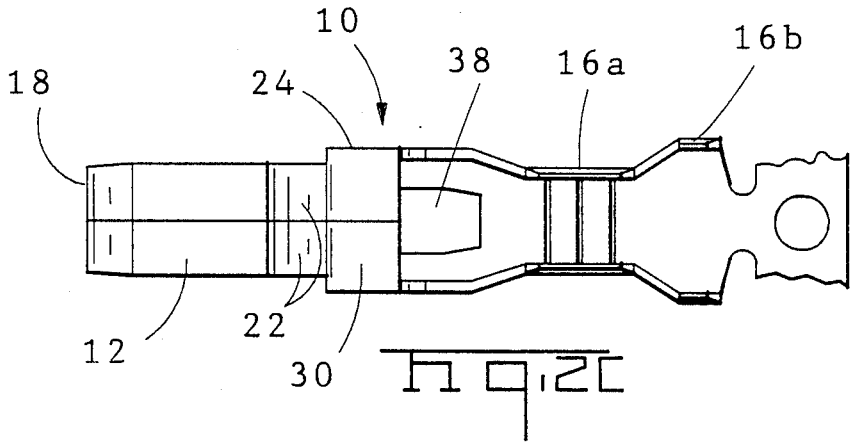
Figure 4:
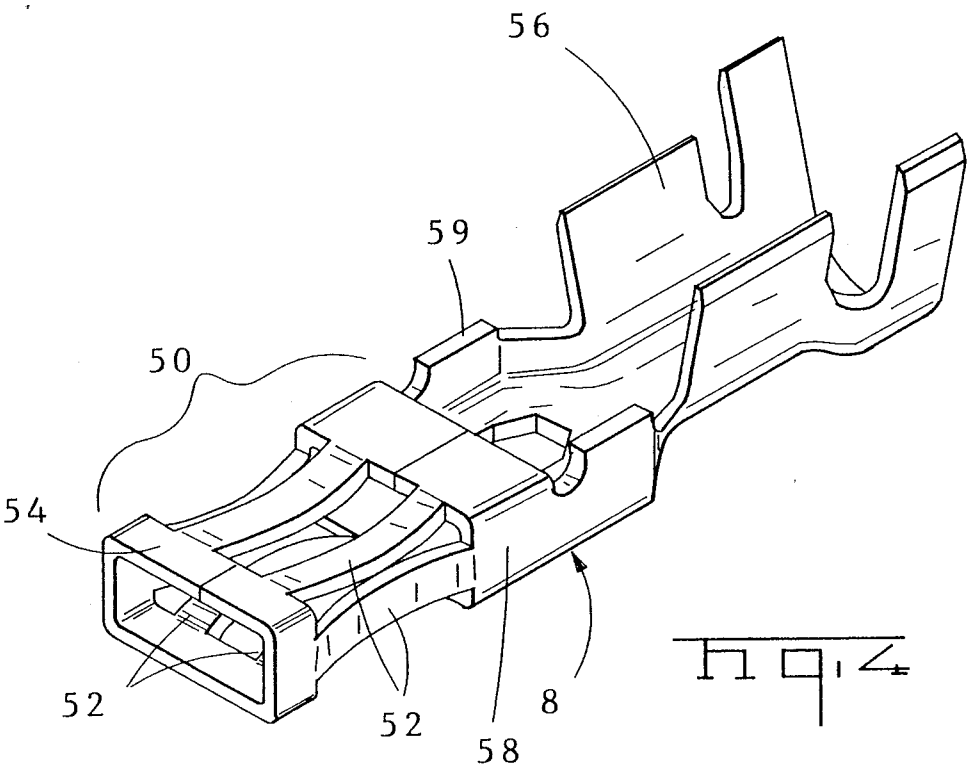
FIG. 4 is a perspective view of the receptacle terminal.
Figures 5A, 5B:
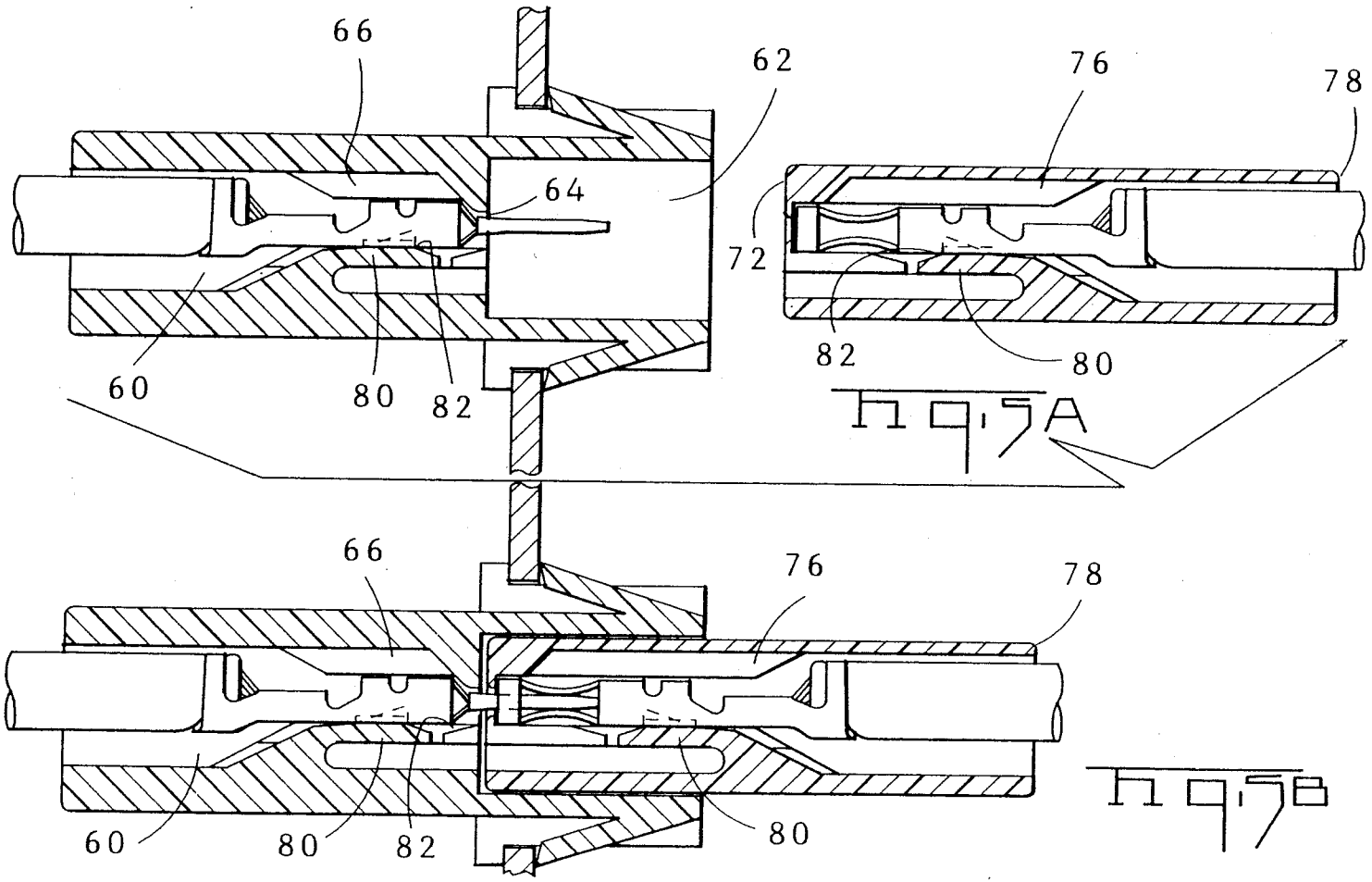
FIGS. 5A and 5B are respectively unmated and mated section views of the two matable connector subassemblies.
Figure 6C:
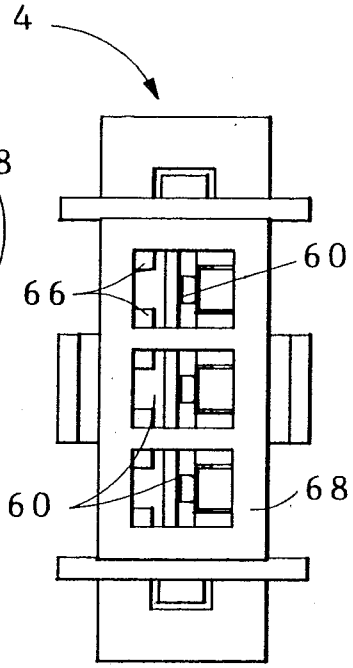
FIGS. 6A, 6B and 6C are respectively side, front and rear views of the housing containing the blade terminals.
Figure 6A:
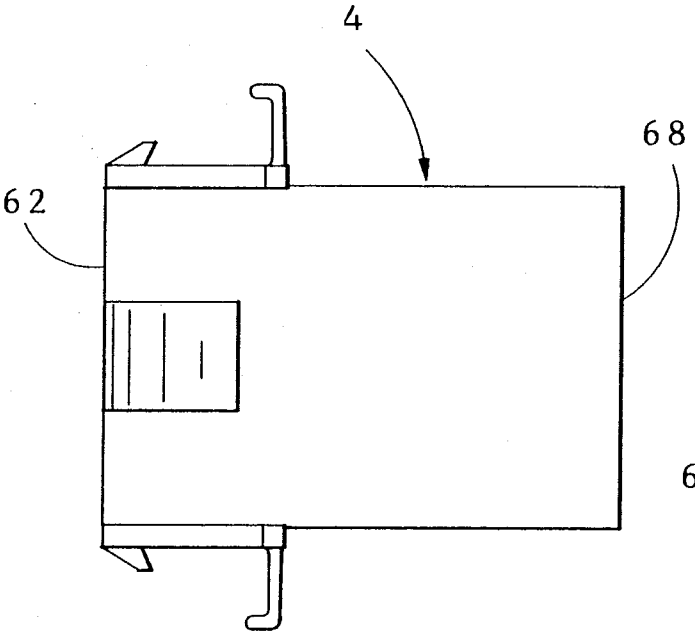
Figure 6B:
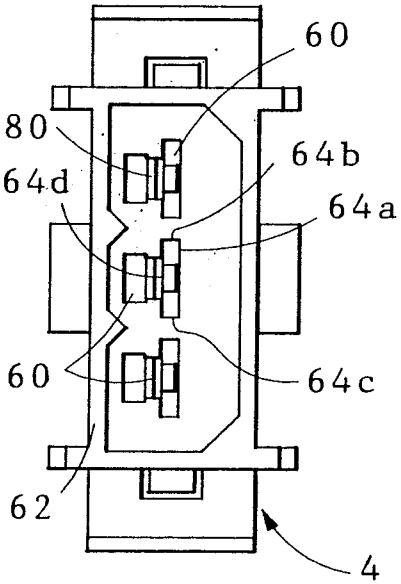

FIGS. 2 and 3 depict the details of the stamped and formed blade terminal 10. These terminals 10 include a blade section 12 on the mating end 18 integral with a wire contact or crimp section 16 of conventional construction. Crimp section 16 includes a conventional wire crimp portion 16*a* and a conventional insulation crimp section 16*b*. In the preferred embodiment, a box section 30 is located between the blade 12 and the crimp section 16. This blade terminal 10 is fabricated by forming or folding the flat blank 42 shown in FIG. 7. The blade 12 is formed by folding edge portions 34 of the flat blank 42 to form a dual thickness blade. These edge portions 34 are juxtaposed edge to edge when folded over flaps 20 which extend longitudinally relative to the axis of the terminal 10. Blade 12 comprises an inwardly formed integral extension of one side, or a base section 36, of a rectangular contact positioning section or box section 30. Blade 12 is disposed to extend from the center of the rectangular box section 30 between the flaps 20 and the base section 36. Blade 12 is secured to the top of the contact positioning box section above the base section 36 by flaps 20. An upwardly inclined blade root section 14 extends from the base section 36 toward the flap 20. A downwardly inclined flap root section 22 is adjacent the blade 12 and is inclined from the top of the box section 30 toward the blade 12. Blade 12 is therefore centrally disposed to the top and the bottom of the rectangular box section 30.

Figure 7A:
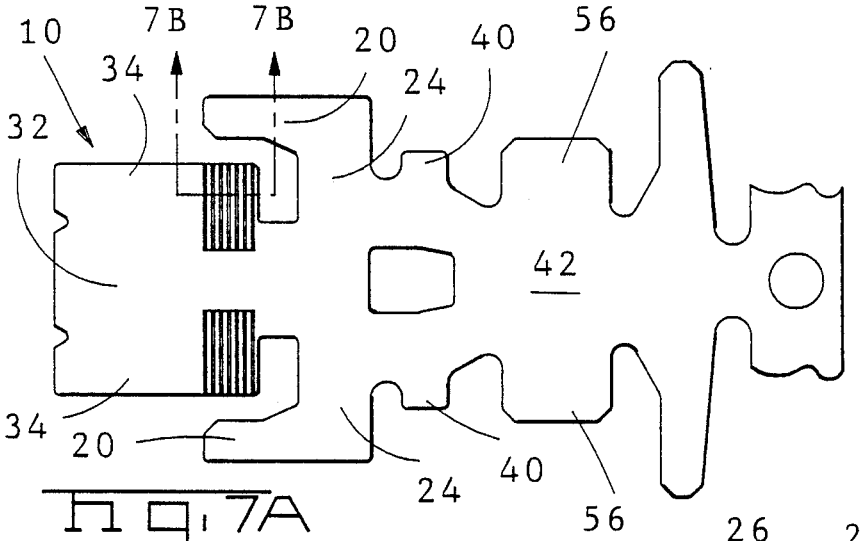
FIGS. 7A and 7C are respectively top and bottom views of the flat blank from which a blade terminal is formed.
Figure 7B:
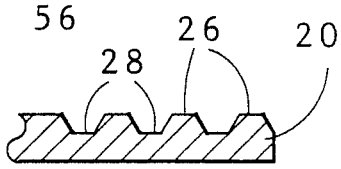
FIGS. 7B and 7D are section views taken along section lines 7B—7B and 7D—7D respectively.
Figure 7C:
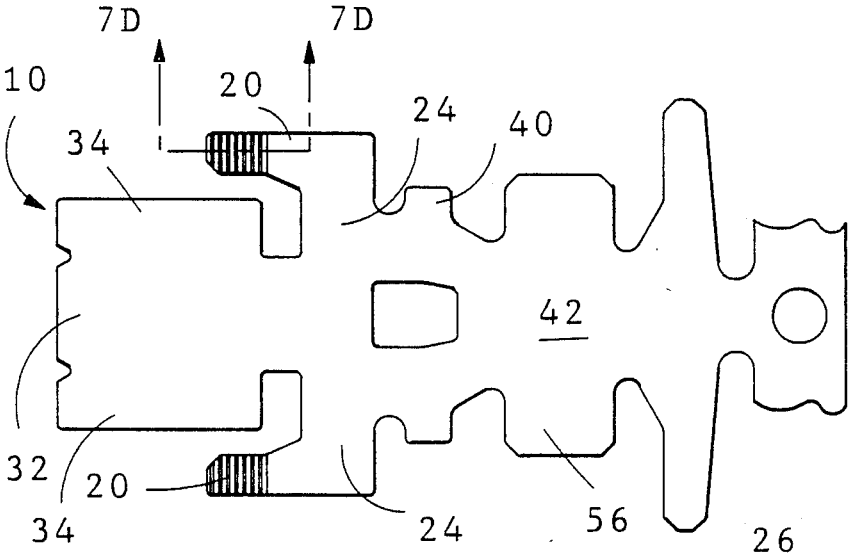
Figure 7D:
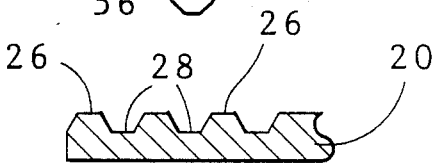

Flaps 20 initially comprise integral sections of the flat blank 42 outboard of edge sections 34. These longitudinally extending flaps are joined to the remainder of the flat blank 42 by integral lateral sections 24, which in combination with the flaps 20 form L-shaped sections of the flat blank 42. The two flaps 20 extend from the top of the box section 30 to anchor or secure the blade 12 in position centrally between the top and bottom of the box section 30. As best shown in FIG. 3B, each flap 20 is joined to the blade 12 by interfitting tongues 26 and grooves 28. Alternating tongues and grooves 26, 28 are formed on the upper surface of the edge portions 34 of the flat blank 42 as shown in FIG. 7A. Complementary tongues and grooves 26,28 are formed on the lower surface of flaps 20 of the flat blank 42 as shown in FIG. 7B. In the preferred embodiment, tongues and grooves 26, 28 are skived on the upper and lower surfaces of the flat blank 42.

The dual thickness blade 12 if formed from the flat blank 42 by folding lateral sections 24 upwardly from the flat blank 42 into the form of a rectangular box 30 from which the flaps 20 extend toward the mating end 18 of terminal 10. The flaps 20 are parallel to the base portion 36 of the box section 30 and will be centrally located relative to the top and bottom of box section 30 because of the inclined flap root section 22. The edge portions 34 are next folded up from the central section 32 on the front of the flat blank 42 to form the dual thickness blade. Edge portions 34 are folded over the flaps 20 and the interfitting tongues and grooves 26 and 28 engage to anchor the blade 12 centrally relative to the box section 30.

Box section 30 located between the two ends of the blade terminal 10 has blade 12 extending from the front end toward the mating end 18 of the terminal 10 and the wire contact section extending from the other end toward the rear of the terminal 10. As previously described the rectangular box section 30 is formed by folding up lateral sections 20 to form the folded up portions of the box section 30. In other words folded up portions 24 comprise the top and sides of the box section 30 and are integral with the base portion 36, and in the preferred embodiment, these folded up portions abut on the top of the box section 30. A hole or contact retention opening 38 is stamped in the base section 36. The flaps 20 which extend from the front of the box section are received between the folded edge portions 34 and the central section 32 of blade 12. The box section 30 comprises a contact positioning section stabilizing the terminal 10 in the contact receiving cavity 60. In the preferred embodiment, a pair of stabilizing ribs 40, extending upwardly from the terminal base, are located between the box section 30 and the crimp section 16. The height of these stabilizing ribs 40 is the same as the height of the box section 30 and the stabilizing ribs 40 comprise additional stabilization means holding the terminals in place within respective cavities. Box section 30 is located in front of the stabilizing ribs 40 and together they prevent terminal 10 from pitching relative to the housing.

The receptacle terminal 8 also comprises a stamped and formed terminal, preferably, though not necessarily, fabricated from the same material as the blade terminal 10. Receptacle terminal 8 has a receptacle section 50 extending from a contact positioning section 58 extending between a crimp section 56 and the receptacle section 50. The contact positioning section 58 comprises a rectangular box section of somewhat similar construction to the box section 30 in blade terminal 10. The receptacle section 50 comprises a spring members in the form of inwardly curved sections 52 extending from the rectangular contact positioning section 58 to a strap 54 located at the forward or mating end of terminal 8. In the preferred embodiment the strap section 54 has substantially the same dimensions as the contact positioning section 58. Receptacle section 50, including strap 54 thus comprises a folded section generally corresponding to the periphery of the contact positioning section 58 which also comprises a folded up section.

Insulative housings 4 and 6 have a plurality of cavities 60 and 70 respectively extending from rear faces to intermatable mating faces 62 and 72. Housing 4 comprises a female housing and housing 6 comprises a matable male housing. In the preferred embodiment, the housing 4 has three cavities 60 receiving blade terminals 10. The male housing 6 also has three cavities 70 receiving receptacle terminal 8. Each of the cavities 60 and 70 has a generally rectangular cross section conforming generally to the rectangular contact positioning sections 30 and 58 of terminals 10 and 8 respectively. Apertures 64 and 74 are located on the mating faces 62 and 72 respectively. These apertures are each dimensioned so that the blade 12 on terminal 10 can extend through the aperture for mating with receptacle section 50 of terminal 8. Each cavity 60 has stabilizing ledges 66 located on each side. Similar stabilizing ledges 76 are located in cavities 70. These ledges support the sides of the rectangular contact stabilization section 30 and 58 and form a portion of the top of the generally rectangular shape of each cavity. Each housing includes and integral resilient latch 80 located on the bottom of each cavity. This latch 80 forms the bottom of the generally rectangular cavity. Latch 80 includes a latching finger located between the stabilizing ledges 66, 76 located on the opposite wall of the corresponding cavity. Resilient latches 80 are of conventional construction and are partially molded by a core pin extending through the apertures 64, 74 located in the mating faces of the housings. Each resilient latch 80 will deflect when a terminal 8 or 10 is inserted into its appropriate cavity from the rear of the respective housing. A finger or shoulder 82 is located on the upper surface of each tab 80, and this finger is dimensioned so that it can be received in a hole located in the base of the corresponding terminal when the terminal is inserted in the respective housing in the orientation shown in the drawings. If either terminal is inserted upside down, the finger will still secure the respective terminal properly in position in the housing because the finger 82 will engage the rear edge of the top section of the respective contact positioning box section 30 or 58. This is possible because the width of the finger 82 is less than the spacing between the stabilizing ribs on each terminal.

The terminals 8 and 10 are each centered within their respective cavities. Receptacle terminal 8 has box section 58, whose outer periphery corresponds to the generally rectangular cross section of cavity 70. Stabilizing ribs 59 and strap 54 also corresponding to the generally rectangular cross section of cavity 70 so that terminal 8 is stabilized at the longitudinal points within cavity 70, and terminal 8 is stabilized in four directions at each point regardless of the orientation of terminal 8. Terminal 10 is stabilized in four directions by box section 30 and by stabilizing ribs 40. Aperture 64 is shaped so that the blade 12 fits tightly against three sides of the aperture 64. Blade 12 does not, however, fit tightly against the fourth side of the aperture 64 because of the clearance necessary to form latch 80 along that fourth side. However the blade 12 is an extension of the base section 36 and is anchored to the top of the box section 30 by the flaps 20 and the interfitting tongues and grooves 26 and 28 so that the blade is not free to pitch or rock towards the fourth side along which the resilient latch is located. Since both the blade 12 and the receptacle section 50 of the receptacle terminal 8 are firmly held in position in their respective housings, relatively precise and unchanging points of electrical contact can be established between the blade 12 and the contact springs 52. These points will be at the apex of the curved springs 52 which will be deflected outwardly upon insertion of the blade 12 between the four springs 52.

I claim:

1. A stamped and formed electrical terminal comprising a male blade for being received in a female contact member and an integral wire contact section, the terminal being characterized in that said blade is formed by folding edge portions of a flat blank to form a dual thickness blade, the edge portions being juxtaposed when folded, the edge portions being folded over and secured to at least one flap, each flap initially comprising an integral section of the flat blank outboard of the edge portions.

2. The electrical terminal of claim 1 wherein the edge portions are secured to each flap by interfitting tongues and grooves.

3. The electrical terminal of claim 2 wherein the flaps extend only over a portion of the length of the blade.

4. The electrical terminal of claim 3 wherein each flap has a flap root section adjacent the blade and inclined toward the blade.

5. The electrical terminal of claim 4 wherein each blade has a blade root section inclined toward the flap.

6. The electrical terminal of claim 5 wherein the flaps comprise longitudinally extending sections initially joined to the remainder of the flat blank by integral lateral sections forming L-shaped members in combination with the longitudinally extending flaps.

7. The electrical terminal of claim 6 wherein the integral lateral sections are formed upwardly from a base section of the flat blank to form a box section between the blade and the wire contact section.

8. The electrical terminal of claim 7 wherein the blade is disposed to extend from the center of the box section between the flaps and the base section.

9. The electrical terminal of claim 8 wherein a contact retention opening is formed in the base section of the flat blank.

10. The electrical terminal of claim 9 wherein the wire contact section comprises a crimp section.

11. A stamped and formed electrical terminal comprising a box section having a male blade for being received in a female contact member extending from one end and a wire receiving contact section extending from another end, the terminal being characterized in that said blade is disposed above the plane of a base portion of the box section and is secured to the box section by means extending from the box section above the base portion and which are joined to said blade by interfitting tongues and grooves to anchor the blade in position.

12. The electrical terminal of claim 11 wherein the blade is centrally disposed relative to the box section.

13. The electrical terminal of claim 12 wherein the blade is parallel to the base portion.

14. The electrical terminal of claim 13 wherein the blade is joined to the base portion by a inclined blade root section.

15. The electrical terminal of claim 11 wherein at least one flap extends from the top of the box section to anchor the blade in position.

16. The electrical terminal of claim 15 wherein each flap is inclined from the top of the box section toward the blade.

17. The electrical terminal of claim 16 wherein each flap is joined to the blade by interfitting tongues and grooves.

18. The electrical terminal of claim 17 wherein the box section is formed by folding up portions on the terminal on opposite sides of the base position, each flap extending from the folded up portions forming the box section.

19. The electrical terminal of claim 18 wherein the folded up portions abut above the base portion.

20. The electrical terminal of claim 19 wherein two flags extend from adjacent abutting folded up portions to the interfitting tongues and grooves.

* * * * *

UNITED STATES PATENT OFFICE

CERTIFICATE OF CORRECTION

Patent No. 4,979,915 Dated December 25, 1990

Inventor(s) Daines M. Self Jr.

It is certified that error appears in the above-identified patent and that said Letters Patent is hereby corrected as shown below:

Claim 20, Column 6, Line 65 - The word "flags" should be --flaps--.

Signed and Sealed this

Twenty-first Day of July, 1992

*Attest:*

DOUGLAS B. COMER

*Attesting Officer*

*Acting Commissioner of Patents and Trademarks*